US007013579B2

(12) United States Patent
Szczesuil et al.

(10) Patent No.: US 7,013,579 B2
(45) Date of Patent: Mar. 21, 2006

(54) ARTICLE OF FOOTWEAR WITH TEMPERATURE REGULATION MEANS

(75) Inventors: Stephen Szczesuil, Framingham, MA (US); Michael J. Holthe, Holliston, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/207,633

(22) Filed: Aug. 19, 2005

(65) Prior Publication Data

US 2005/0274038 A1 Dec. 15, 2005

Related U.S. Application Data

(62) Division of application No. 10/660,386, filed on Sep. 11, 2003.

(51) Int. Cl.
*A43B 7/02* (2006.01)

(52) U.S. Cl. ..... 36/2.6; 219/211; 36/43

(58) Field of Classification Search ..... 36/2.6, 36/3 R, 3 B, 43, 44; 219/211; 126/204, 126/208, 210
See application file for complete search history.

(56) References Cited

U.S. PATENT DOCUMENTS

| | | | | |
|---|---|---|---|---|
| 1,761,829 | A * | 6/1930 | Heinemann | 36/2.6 |
| 3,946,193 | A * | 3/1976 | Giese | 219/211 |
| 4,000,566 | A | 1/1977 | Famolare, Jr. | |
| 4,078,321 | A | 3/1978 | Famolare, Jr. | |
| 4,258,480 | A | 3/1981 | Famolare, Jr. | |
| 4,281,418 | A * | 8/1981 | Cieslak et al. | 2/160 |
| 4,799,319 | A | 1/1989 | Zellweger | |
| 4,800,867 | A * | 1/1989 | Owens | 126/204 |
| 4,953,309 | A * | 9/1990 | Kaiser | 36/2.6 |
| 5,320,164 | A | 6/1994 | Szczesuil et al. | |
| 5,538,583 | A | 7/1996 | Szczesuil et al. | |
| 5,829,171 | A * | 11/1998 | Weber et al. | 36/93 |
| 5,996,250 | A | 12/1999 | Reed et al. | |
| 6,041,518 | A | 3/2000 | Polycarpe | |

* cited by examiner

*Primary Examiner*—Ted Kavanaugh
(74) *Attorney, Agent, or Firm*—Vincent J. Ranucci

(57) ABSTRACT

Article of footwear includes a sole, an insole overlying the sole, the insole having in a surface thereof a groove having an inlet and outlet in an edge of the insole, the groove winding substantially throughout the length and width of the insole upper surface. A tube is disposed in the groove and extends throughout the length of the groove and has an inlet portion extending from the groove inlet at the edge of the insole and an outlet portion extending from the groove outlet. An upper fixed to the sole has apertures through which extend the tube inlet and outlet portions.

11 Claims, 8 Drawing Sheets

ARTICLE OF FOOTWEAR WITH TEMPERATURE REGULATION MEANS

This application is a Divisional of U.S. application Ser. No. 10/660,386 filed on Sep. 11, 2003 still pending.

STATEMENT OF GOVERNMENT INTEREST

The invention described herein may be manufactured and used by the U.S. Government for Governmental purposes without the payment of any royalty thereon.

BACKGROUND OF THE INVENTION

1. Field of the Invention

The invention relates to footwear and is directed more particularly to an article of footwear with temperature regulation means.

2. Description of the Prior Art

Footwear provided with means for circulating cooling or ventilation air through the footwear is generally known. For example, in U.S. Pat. No. 4,000,566, issued Jan. 4, 1977, in the name of Joseph P. Famolare, there is shown footwear having air channels in the sole. The channels open at air ports in the edges of the sole. The air ports and channels provide for circulation of air through the channels.

In U.S. Pat. No. 5,996,250, issued Dec. 7, 1999, in the name of Rusty A. Reed et al, there is disclosed an air ventilation system in the sole, the system including pressure-operated pumps for forcing ventilating air through the system.

U.S. Pat. No. 4,799,319, issued Jan. 24, 1989, in the name of Max Zellweger, discloses a foot warming system in the insole of footwear. The warming system includes elongated tubular members which are closed and have flow restrictions therein. Walking in the footwear causes the liquid in the tubular members to flow back and forth through the restrictors which thereby heat the liquid and thereby the insole.

In U.S. Pat. No. 6,041,518, issued Mar. 28, 2000, in the name of Phito Polycarpe, there is shown and described footwear having a battery, heater and fan in the sole to heat and circulate warm air in the sole and through an insole and insert to warm a foot in the footwear.

In spite of advances, as illustrated in the above referred to references, there remains a need for footwear which can selectively heat and cool the foot of a wearer. In particular, there is a need for an article of footwear which is able to provide robust and appropriate relief in both the arctic and in Equatorial zones.

SUMMARY OF THE INVENTION

An object of the invention is, therefore, to provide an article of footwear having facility for providing substantial heating or cooling of the foot of a wearer of the footwear.

With the above and other objects in view, a feature of the invention is the provision of footwear with temperature regulation means. The footwear comprises a sole forming a bottom of the footwear, an insole overlying the sole and in contact with the sole, the insole having in an upper surface thereof opposite from the sole a groove having an inlet and an outlet in an edge of the insole, the groove winding substantially throughout the length and width of the insole upper surface with a plurality of generally 180° turns in the insole. A tube is disposed in the groove and extends throughout the length of the groove and is provided with an inlet portion extending from the groove inlet at the edge of the insole and an outlet portion extending from the groove outlet at the edge of the insole. An upper is fixed to the sole and is provided with apertures therethrough through which extend the tube inlet and outlet portions. A holding member is fixed to the upper and covers the tube inlet and outlet portions. A liquid reservoir is provided having temperature influencing means therewith and connected to remote ends of the tube inlet and outlet portions. In operation, temperature conditioned liquid is flowed from the liquid reservoir through the tube to provide a selected temperature to the insole, and flowed back to the liquid reservoir for a further cycle.

In accordance with a further feature of the invention, there is provided footwear with temperature regulation means. The footwear comprises a sole forming a bottom of the footwear, an upper fixed to the sole, an insole fixed to overlie an upper surface of the sole and overlie inwardly-extending edge portions of the upper. The footwear includes an insert for selective insertion and removal from the interior of the footwear and adapted, upon insertion, to overlie the insole, the insert having in a selected surface thereof a groove having an inlet and an outlet in an edge of the insert, the groove winding substantially throughout the length and width of the insert selected surface with a plurality of generally 180° turns in the insert. A tube is disposed in the groove and extends throughout the length of the groove and is provided with an inlet portion extending from the groove inlet at the edge of the insert and an outlet portion extending from the groove outlet at the edge of the insert. The footwear is further provided with first and second tubes mounted on the upper and having first ends proximate the apertures and adapted for engagement with the tube inlet and outlet portions, and having second ends remote from the insert. A liquid reservoir is provided having temperature influencing means therewith and connected to remote ends of the first and second tubes. In operation, temperature conditioned liquid is flowed from the liquid reservoir through the first tube to provide a selected temperature to the insert, and flowed back through the second tube to the liquid reservoir for a further cycle.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
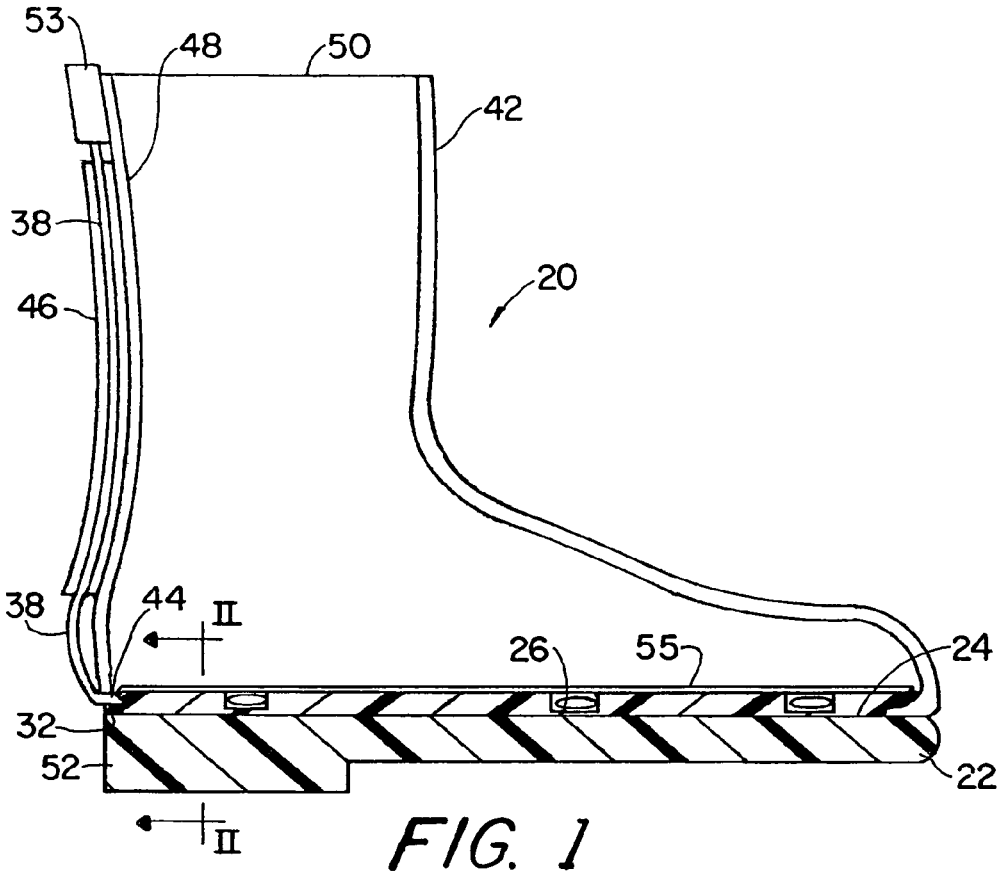
FIG. 1 is a center-line sectional view of one form of an article of footwear illustrative of an embodiment of the invention.
Figure 2:
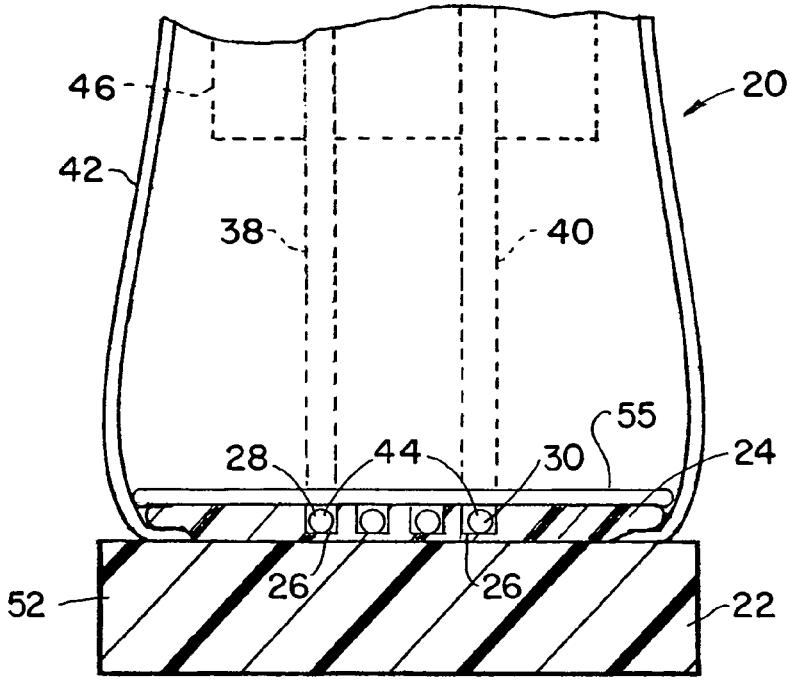
FIG. 2 is a sectional view taken generally along line II—II of FIG. 1.
Figure 3:
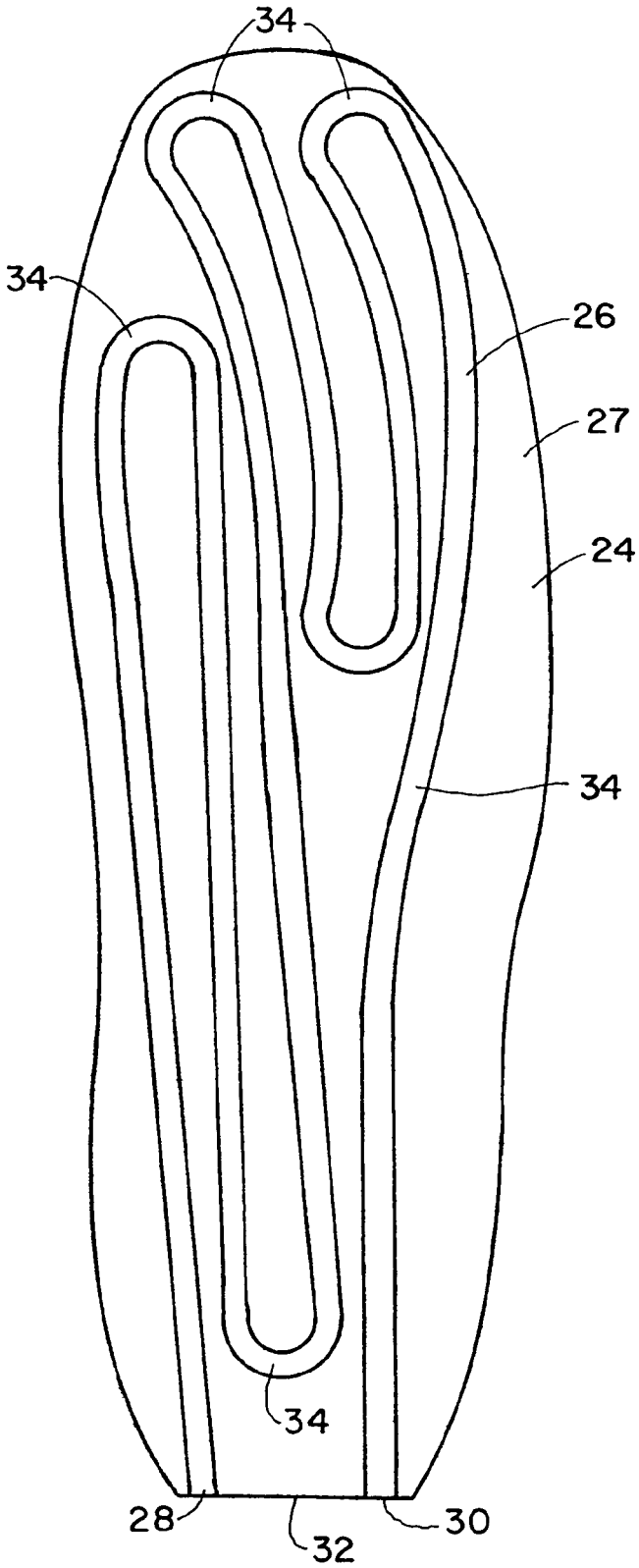
FIG. 3 is a top view of an insole portion of the footwear of FIGS. 1 and 2.

Referring to FIGS. 1 and 2, it will be seen that an illustrative article of footwear 20 includes a sole 22 forming a bottom of the footwear. An insole 24 overlies the sole 22. The insole 24 is provided with a groove 26 in one surface 27 thereof (FIG. 3). The groove 26 includes an inlet 28 and outlet 30 in an edge 32 of the insole 24.

As shown in FIG. 3, the groove 26 winds substantially throughout the length and width of the insole surface 27 with several generally 180° turns 34 therein.

The insole 24 preferably is of a breathable urethane foam sufficiently flexible to serve as a footwear insole material and sufficiently rigid to render the groove 26 non-compressible under typical human weight load conditions.

Figure 4:
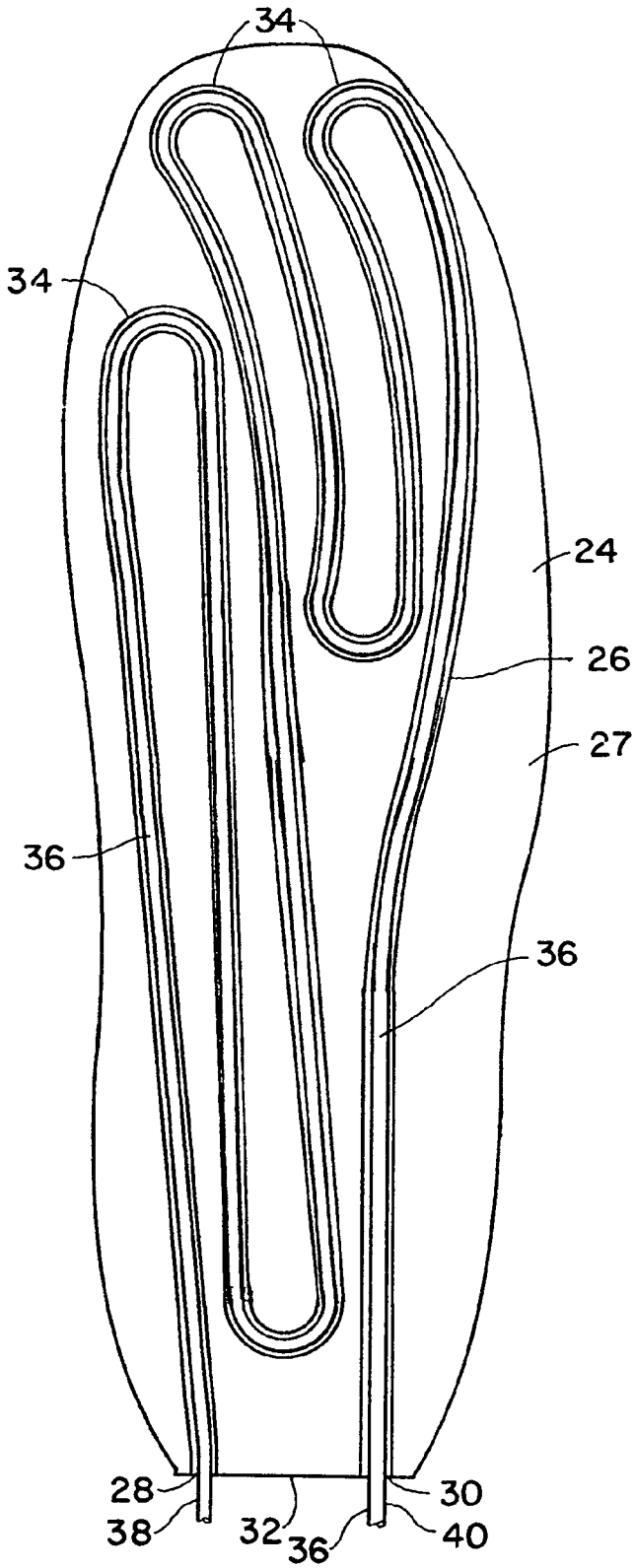
FIG. 4 is a top view of the insole of FIG. 3 with added structure.

Referring to FIG. 4, it will be seen that into the groove 26 in the surface 27 of the insole 24 there is placed a tube 36 which extends throughout the length 6f the groove 26 and having an inlet portion 38 extending from the groove inlet 28 at the edge 32 of the insole 24 and an outlet portion 40 extending from the groove outlet 30 at the edge 32 of the insole. The tube 36 preferably is of a heat-conducting polymer, such as PVC.

An upper 42 (FIGS. 1 and 2) is fixed to the sole 22 and is provided with apertures 44 therethrough, through which extend the tube inlet and outlet portions 38, 40.

In a preferred embodiment, the groove 26 is about 5/32 inch wide and 5/32 inch deep, and the tube 36 is provided with a diameter of about 5/32 inch and an inside diameter of about 3/32 inch. The tube may be provided with a thin coating of thermally activatable material on the exterior of the tube.

The footwear 20 is provided with a holding member 46 (FIGS. 1 and 2) which serves as a protective covering fixed to the footwear upper 42. The tube inlet and outlet portions 38, 40 extend through the holding member 46 and are protected thereby.

When the footwear 20 takes the form of a boot, the tube inlet and outlet portions 38, 40 extend from the upper apertures 44 proximate a heel portion 52 of the boot up the back of a bootleg portion 48 to proximate the top 50 of the bootleg portion.

A thermoelectric cooler/heater unit 53 may be fastened to the top of the bootleg portion 48, or may be mountable on the clothing of the wearer. In either case, the tube portions 38, 40 are connected to the unit 53. A sock lining 55 may be placed over the insole 24, as shown in FIGS. 1 and 2.

In an alternative embodiment, shown in FIGS. 5–8, the sole 22 and upper 42 are substantially as shown and described relative to the embodiment shown in FIGS. 1 and 2. However, the insole 24 is a traditional insole and there is provided an insert 54 made and structured as described hereinabove with respect to the insole of the embodiment of FIGS. 1 and 2.

Figure 8:
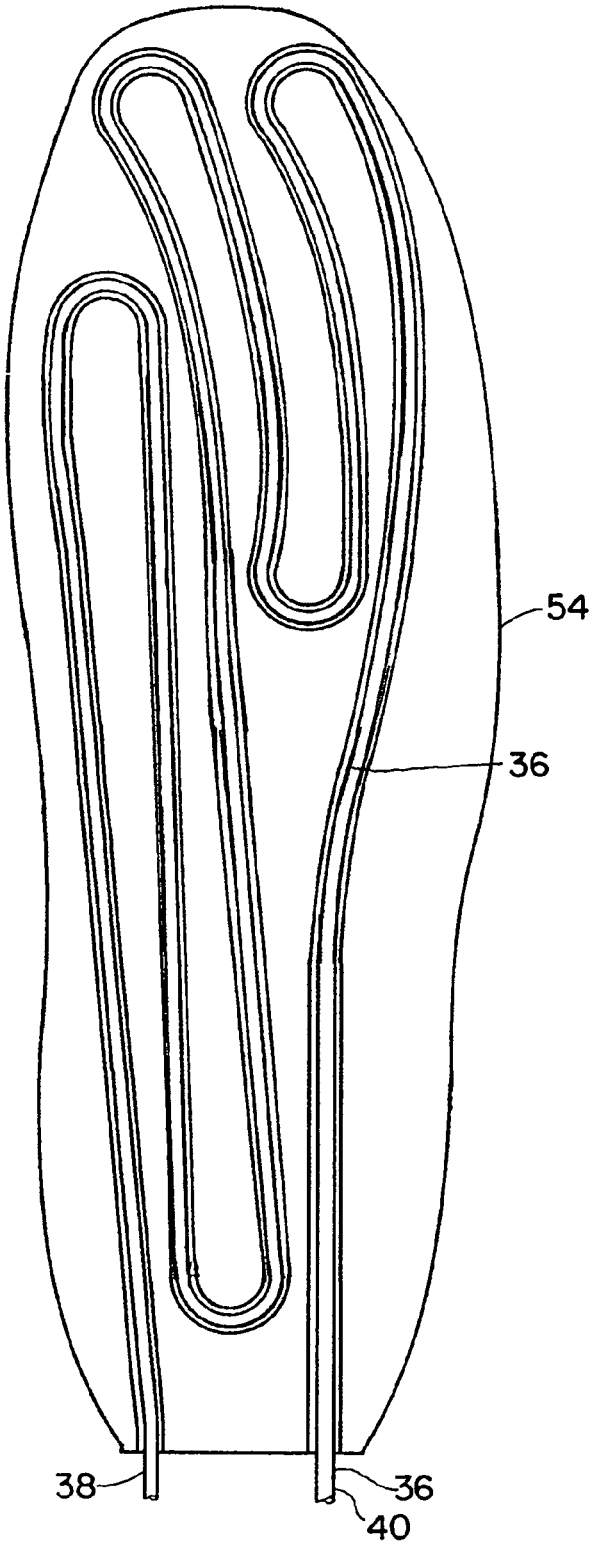
FIG. 8 is a top view of the insert of FIG. 7 with added structure.

Accordingly, the insert 54 is provided with the above-described groove 26 (FIG. 7) and tube 36 (FIG. 8). In this embodiment, the tube inlet and outlet portions 38, 40 are fed through the apertures 44 in the upper 42 (FIGS. 5 and 6), the holding member 46, and plugged into the thermoelectric cooler/heater unit 53. The insert 54 is then slid into position overlying the insole 24. In footwear of a shoe configuration, rather than a boot configuration, the cooler/heater unit 53 is generally carried on the person of the shoe wearer.

Figure 5:
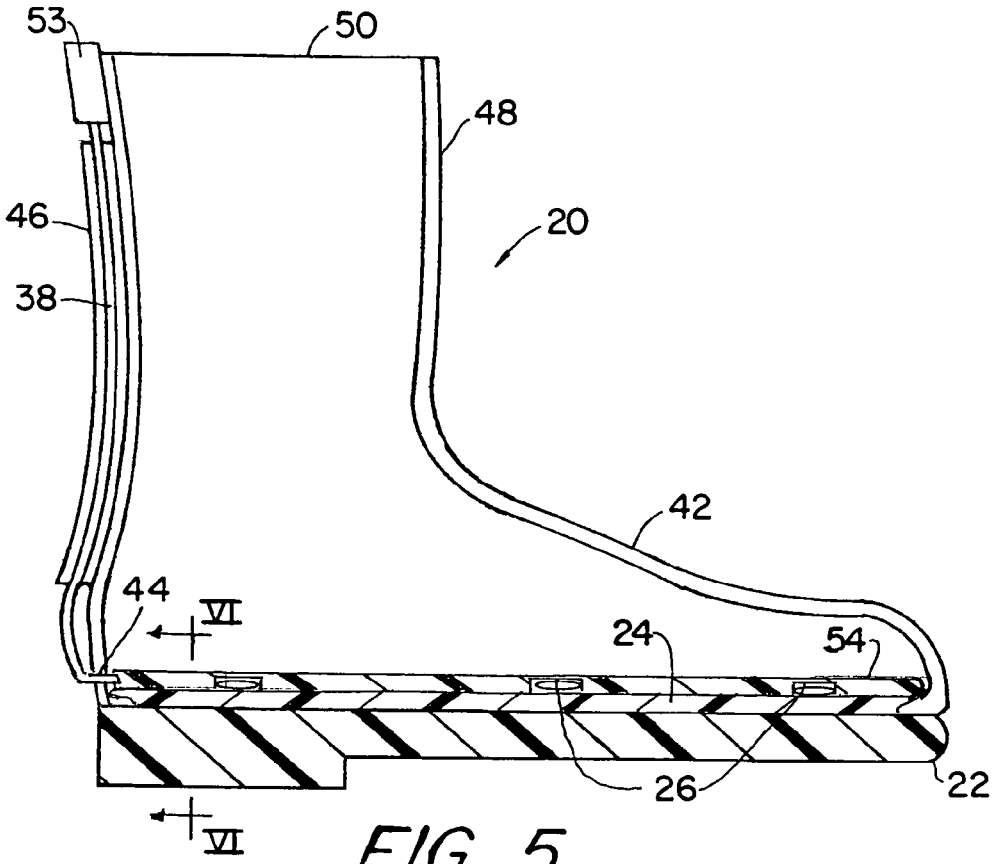
FIG. 5 is similar to FIG. 1 but illustrative of an alternative embodiment.
Figure 6:
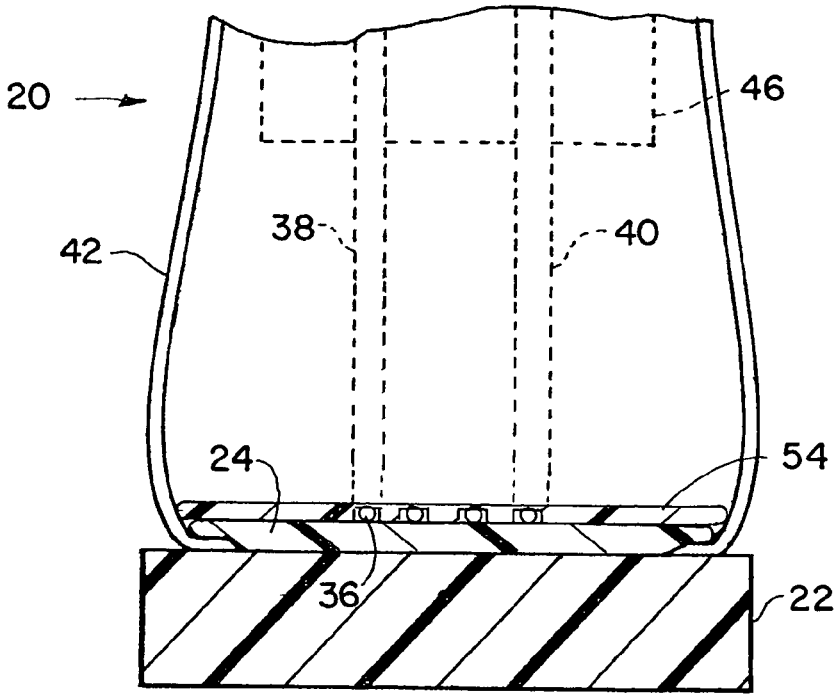
FIG. 6 is a sectional view taken generally along line VI—VI of FIG. 5.
Figure 7:
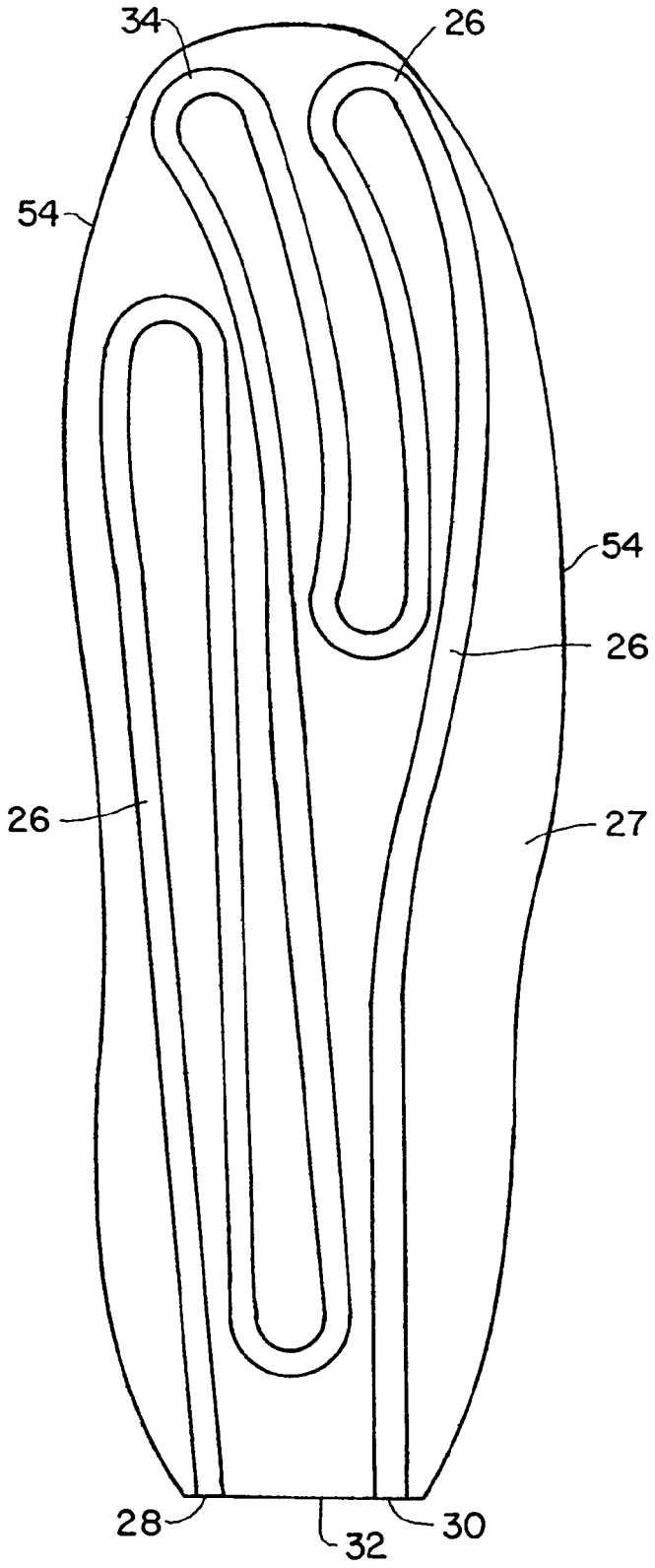
FIG. 7 is a top view of an insert portion of the footwear of FIGS. 5 and 6.

In FIGS. 5 and 6, the insert 54 is shown with the groove 26 and tube 36 disposed on the undersurface of the insert. Alternatively, the groove 26 and tube 36 may be provided on the upper surface of the insert. In such instances, the sock lining 55 may be placed so as to overlie the insert 54.

Figure 9:
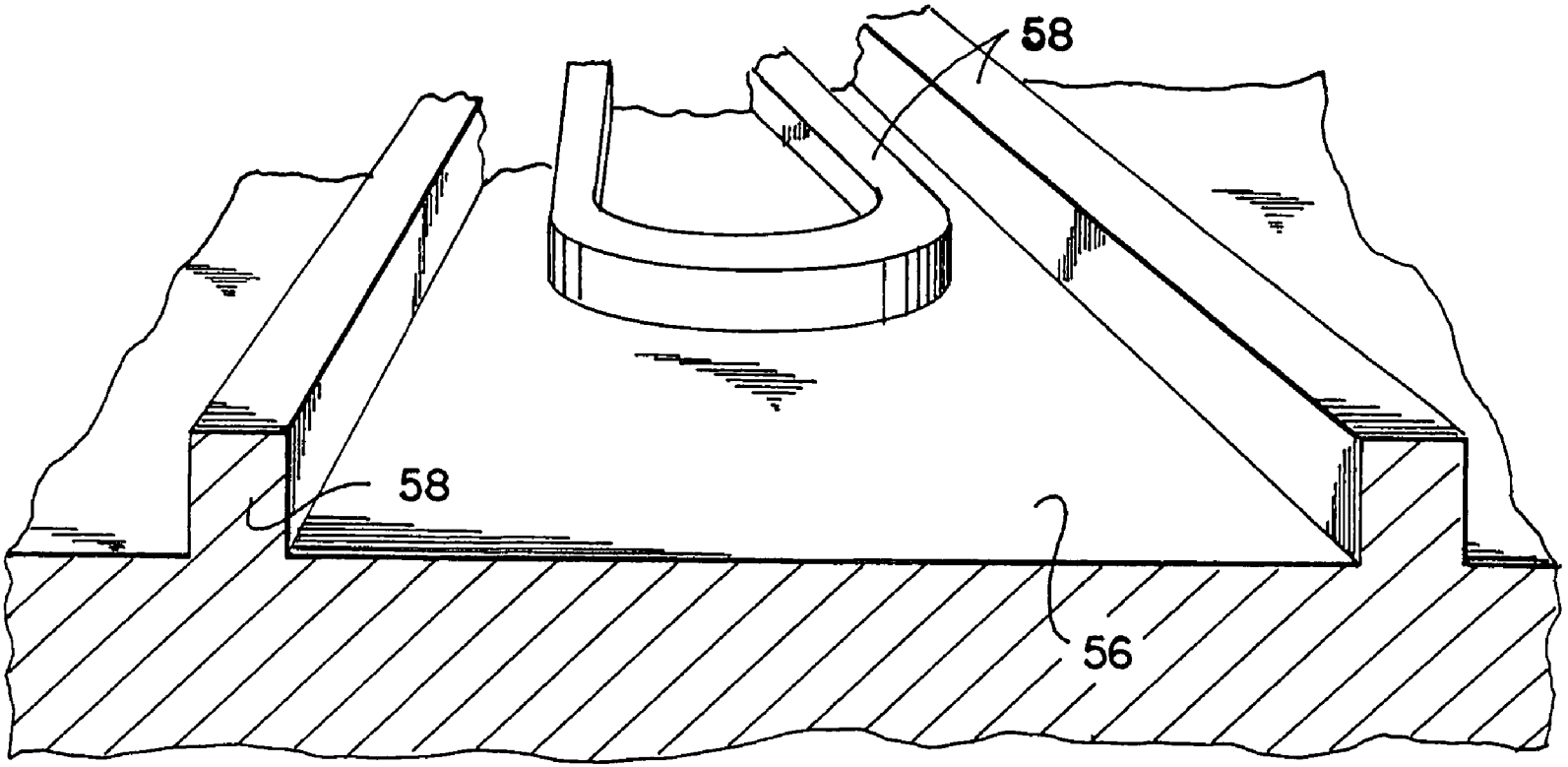
FIG. 9 is a sectional and perspective view of a die for forming the groves in the insole of FIG. 3 and the insert of FIG. 7.
Figure 10:
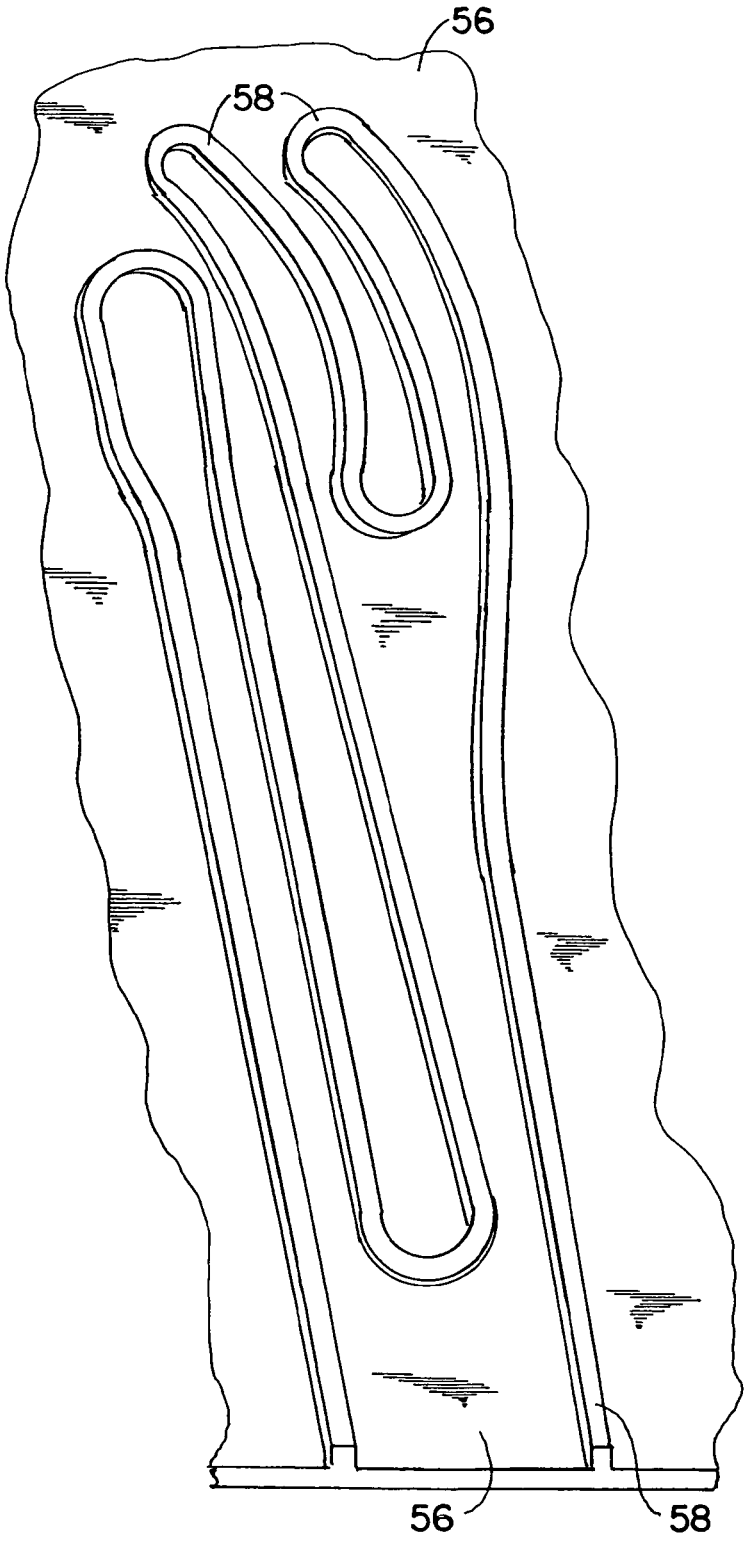
FIG. 10 is a generally top and perspective view of the die of FIG. 9.

In manufacture, the groove 26 may be formed in the urethane insole 24 and inset 54 by a heated die 56 under pressure (FIGS. 9 and 10). In a preferred method of manufacture, an aluminum die is heated to about 400° F. and applied to the insole material under pressure of about 500 p.s.i. Partial heating of the insole is an optional aid in the process. The die 56 includes upstanding ridges 58 which form the grooves 26.

In either embodiment, the cooling or heating is regenerative in nature, with water or other liquid continuously flowed through the tube 36 for control of foot temperature.

In addition to being useful in hot or cold climates, the footwear described herein finds utility in serving the needs of foundry workers, police and fire personnel, hunters, miners, and people suffering from certain medical conditions. Further, the above described manufacturing process may be used for producing other sheets of material for beneficially providing a cooled or heated surface, such as sleeping bag mats, tent floors, and the like, which typically undergo stresses produced by people walking, lying, or sitting thereon.

It will be understood that many additional changes in the details, materials, steps and arrangement of parts, which have been herein described and illustrated in order to explain the nature of the invention, may be made by those skilled in the art within the principles and scope of the invention as expressed in the appended claims.

The foregoing describes the invention in terms of embodiments foreseen by the inventors and for which an enabling description is available. Insubstantial modifications of the invention not presently foreseen may nonetheless represent equivalents.

What is claimed is:

1. An article of footwear with temperature regulation means, the article comprising:

a sole forming a bottom of the footwear;

an upper fixed to said sole;

an insole fixed to overlie an upper surface of said sole and overlie inwardly-extending edge portions of said upper;

an insert for selective insertion and removal from the interior of the footwear and adapted, upon insertion, to overlie, said insole, said insert having in a selected surface thereof a groove having an inlet and an outlet in an edge of said insert, said groove winding substantially through out the length and width of the insert selected surface with a plurality of generally 180° turns therein;

a tube disposed in the groove and extending throughout the length of the groove and having an inlet portion extending from the groove inlet at the edge of said insert and an outlet portion extending from the groove outlet at the edge of said insert;

first and second tubes mounted on said upper and having first ends proximate said apertures and adapted for engagement with the tube inlet and outlet portions, and having second ends remote from said insert; and a reservoir having temperature influencing means therewith and connected to the remote ends of said first and second tubes; wherein temperature conditioned means is furnished from said reservoir through said tube to provide a selected temperature to said insert, and furnished back to said reservoir for a further cycle.

2. The article of footwear in accordance with claim 1 wherein said insert is of a breathable urethane foam sufficiently flexible to serve as footwear insert material and sufficiently rigid to render said groove non-compressible under typical human weight load conditions.

3. Footwear in accordance with claim 2 wherein said tube is of a heat-conducting polymer.

4. Footwear in accordance with claim 2 wherein said tube is of PVC.

5. Footwear in accordance with claim 2 wherein said groove is about 5/32 inch wide and 5/32 inch deep and said tube is provided with an outer diameter of about 5/32 inch.

6. Footwear in accordance with claim 5 wherein said tube is provided with an inside diameter of about 3/32 inch.

7. Footwear in accordance with claim 2 and further comprising a coating of thermally activated material on the exterior of said tube.

8. The footwear in accordance with claim 2 wherein said groove is a heat and pressure die formed groove in the urethane foam.

9. The article of footwear in accordance with claim 1 wherein said temperature conditioned means is a fluid.

10. The article of footwear in accordance with claim 9 wherein the fluid is liquid.

11. The article of footwear in accordance with claim 1 wherein said temperature conditioned means is a conductor of electricity.

* * * * *